US012529203B2

(12) United States Patent
Narikawa et al.

(10) Patent No.: US 12,529,203 B2
(45) Date of Patent: Jan. 20, 2026

(54) WORK MACHINE

(71) Applicant: HITACHI CONSTRUCTION MACHINERY CO., LTD., Tokyo (JP)

(72) Inventors: Ryu Narikawa, Mito (JP); Teppei Saitoh, Mito (JP); Tadashi Kotani, Kashiwa (JP); Koji Fujita, Tsukuba (JP); Hideaki Ito, Katori (JP); Hidefumi Ishimoto, Tsukuba (JP); Kei Sato, Toride (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 146 days.

(21) Appl. No.: 18/689,660

(22) PCT Filed: Dec. 5, 2022

(86) PCT No.: PCT/JP2022/044767

§ 371 (c)(1),
(2) Date: Mar. 6, 2024

(87) PCT Pub. No.: WO2023/106265

PCT Pub. Date: Jun. 15, 2023

(65) Prior Publication Data

US 2024/0376687 A1 Nov. 14, 2024

(30) Foreign Application Priority Data

Dec. 6, 2021 (JP) ..... 2021-197681

(51) Int. Cl.
*E02F 3/43* (2006.01)
*E02F 9/26* (2006.01)

(52) U.S. Cl.
CPC ..... *E02F 3/435* (2013.01); *E02F 3/434* (2013.01); *E02F 9/264* (2013.01); *E02F 3/439* (2013.01)

(58) Field of Classification Search
CPC ... E02F 3/43; E02F 3/431; E02F 3/432; E02F 3/433; E02F 3/434; E02F 3/435;
(Continued)

(56) References Cited

U.S. PATENT DOCUMENTS

2018/0305902 A1 10/2018 Tsukamoto
2020/0224385 A1 7/2020 Saigo et al.
(Continued)

FOREIGN PATENT DOCUMENTS

JP 2018-024997 A 2/2018
JP 2019-132064 A 8/2019
(Continued)

OTHER PUBLICATIONS

Stentz et al., A Robotic Excavator for Autonomous Truck Loading, 1999, Autonomous Robots (Year: 1999).*
(Continued)

*Primary Examiner* — Ramya P Burgess
*Assistant Examiner* — Sara J Lewandroski
(74) *Attorney, Agent, or Firm* — MATTINGLY & MALUR, PC

(57) ABSTRACT

Operations of an upper swing structure and a front work device are controlled such that a swing operation of the upper swing structure starts after a work tool starts only a lifting operation. The lifting operation and the swing operation are performed until the work tool reaches a height position of a passing position and only the swing operation is performed after the work tool reaches the height position of the passing position. The swing operation of the upper swing structure starts to decelerate at a swing deceleration start position, and only the swing operation is performed until the work tool reaches a swing position of the passing position to pass through the passing position. Accordingly, it is possible to reduce the discomfort feeling of an operator
(Continued)

while realizing interference prevention at the time of a loading operation and a stop during the loading operation.

4 Claims, 11 Drawing Sheets

(58) Field of Classification Search
CPC . E02F 3/436; E02F 3/437; E02F 3/438; E02F 3/439; E02F 9/26; E02F 9/261; E02F 9/262; E02F 9/264; E02F 9/265
See application file for complete search history.

(56) References Cited

U.S. PATENT DOCUMENTS

2020/0354921 A1* 11/2020 Nishi ..... E02F 9/123
2021/0002851 A1* 1/2021 Morita ..... E02F 3/439
2021/0002852 A1* 1/2021 Nishi ..... E02F 9/2282
2021/0156114 A1* 5/2021 Saigo ..... F15B 15/20
2021/0246625 A1* 8/2021 Oi ..... E02F 9/265
2021/0292999 A1* 9/2021 Hamada ..... G07C 5/0841
2022/0412041 A1* 12/2022 Konda ..... E02F 3/437

FOREIGN PATENT DOCUMENTS

JP 2021-055262 A 4/2021
WO 2017/115809 A1 7/2017

OTHER PUBLICATIONS

International Preliminary Report on Patentability received in corresponding International Application No. PCT/JP2022/044767 dated Jun. 20, 2024.
International Search Report of PCT/JP2022/044767 dated Jan. 10, 2023.

* cited by examiner

WORK MACHINE

TECHNICAL FIELD

The present invention relates to a work machine.

BACKGROUND ART

An articulated work machine (for example, hydraulic excavator) having front work devices (for example, attachments such as a boom, an arm, and a bucket) driven by a hydraulic actuator has been known. This kind of work machine performs a transportation operation of transporting an object such as excavated earth and sand toward a loaded machine of a transportation machine (for example, a dump truck or the like) and a releasing operation (for example, soil dumping operation) of releasing the object transported by the transportation operation onto the loaded machine, to thereby perform loading work of the object onto the loaded machine.

For example, in a case where loading work to load earth and sand onto a dump truck (loaded machine) is performed by a hydraulic excavator (work machine) having a bucket (work tool), it is conceivable that the bucket interferes with the dump truck when the bucket is moved by swinging in a state where the position of the bucket is low relative to the dump truck. On the other hand, it is conceivable that, if the work of dumping earth and sand is performed in a state where the position of the bucket is excessively high relative to the dump truck, the dump truck is damaged by an impact caused by the falling of the earth and sand. Therefore, when performing the loading work, it is necessary for an operator of the hydraulic excavator to pay attention to the occurrence of interference, the soil dumping height, and the like while checking the position of the dump truck and the position of the bucket and to link the swing operation of an upper swing structure with the operation of the front work devices. Therefore, the operator performing such work needs to acquire skills or support by a support device or the like.

A prior art for supporting the loading work is described in, for example, Patent Document 1. Patent Document 1 discloses a controller for controlling a loading machine including a swing structure that swings about a swing center and a work machine that is attached to the swing structure and has a bucket, and the controller includes an avoidance position specifying section that specifies an interference avoidance position as a bucket position that is higher than a loading object and under which the loading object does not exist, a timing decision section that decides a swing start timing on the basis of a remaining swing angle formed by a straight line extending from the swing center to the work machine and a straight line extending from the swing center to the interference avoidance position in plan view from above and the height of the interference avoidance position, and an operation signal output section that outputs an operation signal of the work machine in a case where the swing start timing has not been reached, and outputs an operation signal for causing the swing structure to swing at a swing speed faster than when the swing start timing has not been reached and an operation signal of the work machine in a case where the swing start timing has been reached.

PRIOR ART DOCUMENT

Patent Document

Patent Document 1: JP-2019-132064-A

SUMMARY OF THE INVENTION

Problem to be Solved by the Invention

In the prior art, in a case where loading work is performed, it is judged that the swing start timing has been reached when an arrival time period for the bucket to reach the height of the interference avoidance position is less than a required swing time period required for the swing structure to swing by the remaining swing angle to the interference avoidance position. However, since such control operates in such a manner as to simultaneously reach the interference avoidance position in the height direction and the swing direction regardless of the start position of the loading operation, there is a concern that the operator feels discomfort due to the deviation between the operation made by the operator and the actual operation.

The same applies to a case in which the loading operation is stopped immediately before reaching the interference avoidance position. In a case where the loading operation is stopped, the time period until the swing operation stops is longer than the time period until the operation of the bucket in the height direction stops. Therefore, in the prior art, even in a case where the loading operation is stopped in the middle, it is necessary to continue the operation of the bucket in the height direction in order to prevent the interference between the loaded machine and the bucket. That is, there is a concern that the operator feels discomfort due to the deviation between the operation made by the operator and the actual operation.

The present invention has been made in view of the above, and an object thereof is to provide a work machine that can reduce the discomfort feeling of an operator while realizing interference prevention at the time of a loading operation and a stop during the loading operation.

Means for Solving the Problem

The present application includes a plurality of means for solving the above problem, and an example thereof is a work machine including a lower track structure, an upper swing structure that is swingably attached onto the lower track structure, an articulated front work device that is attached to the upper swing structure and has a boom, an arm, and a work tool, a posture sensor that senses postures of the upper swing structure and the front work device, a loaded machine position sensor that senses a position of a loaded machine for loading and transporting an excavation object excavated by the front work device, and a controller configured to control at least a part of operations of the upper swing structure and the front work device related to a loading operation of loading the excavation object onto the loaded machine, according to information regarding an excavation position of the excavation object and a soil dumping position of the excavation object onto the loaded machine. The controller is configured to, in the loading operation, compute a height position and a swing position that are positions in a vertical direction and a swing direction, respectively, of a passing position through which the work tool is caused to pass in order for the work tool to reach the soil dumping position from the excavation position while avoiding contact with the loaded machine, on the basis of the excavation position, the soil dumping position, and the position of the loaded machine, and compute, in a swing operation of the upper swing structure until the work tool stops at the soil dumping position after passing through the passing position from the excavation position, a swing deceleration start position at which the upper swing structure starts to decelerate, on the basis of prediction of a change in a swing angle of the upper swing structure from a state where the upper swing structure swings at a predetermined speed until it stops at the soil dumping position. The controller is configured to control operations of the upper swing structure and the front work device such that the swing operation of the upper swing structure starts after the work tool starts only a lifting operation, the lifting operation and the swing operation are performed until the work tool reaches the height position of the passing position, only the swing operation is performed after the work tool reaches the height position of the passing position, the swing operation of the upper swing structure starts to decelerate at the swing deceleration start position, and only the swing operation is performed until the work tool reaches the swing position of the passing position to pass through the passing position.

Advantages of the Invention

According to the present invention, it is possible to reduce the discomfort feeling of an operator while realizing interference prevention at the time of a loading operation and a stop during the loading operation.

MODES FOR CARRYING OUT THE INVENTION

Hereinafter, embodiments of the present invention will be described with reference to the drawings.

It should be noted that, in the following, a hydraulic excavator 1 including a bucket 10 as a work tool (attachment) at the tip of a work device (front work device 2) is exemplified as a work machine, but the present invention may be applied to other work machines having attachments other than the bucket. In addition, the present invention can also be applied to work machines other than the hydraulic excavator as long as an articulated work device configured by coupling a plurality of front members (a work tool, a boom, an arm, and the like) on a swingable structure is provided.

In addition, in the following description, in a case where a plurality of identical constitutional elements exist, an alphabet may be added to the end of the sign (number), but the alphabet may be omitted to collectively express the plurality of constitutional elements. That is, for example, when a plurality of solenoid proportional valves 51*a* to 51*l* exist, they may be collectively expressed as solenoid proportional valves 51. In addition, for the sake of simplicity, illustration of a signal line or the like whose connection relation is obvious by the description may be omitted.

First Embodiment

A first embodiment of the present invention will be described in detail with reference to FIG. 1 to FIG. 9.

Figure 1:
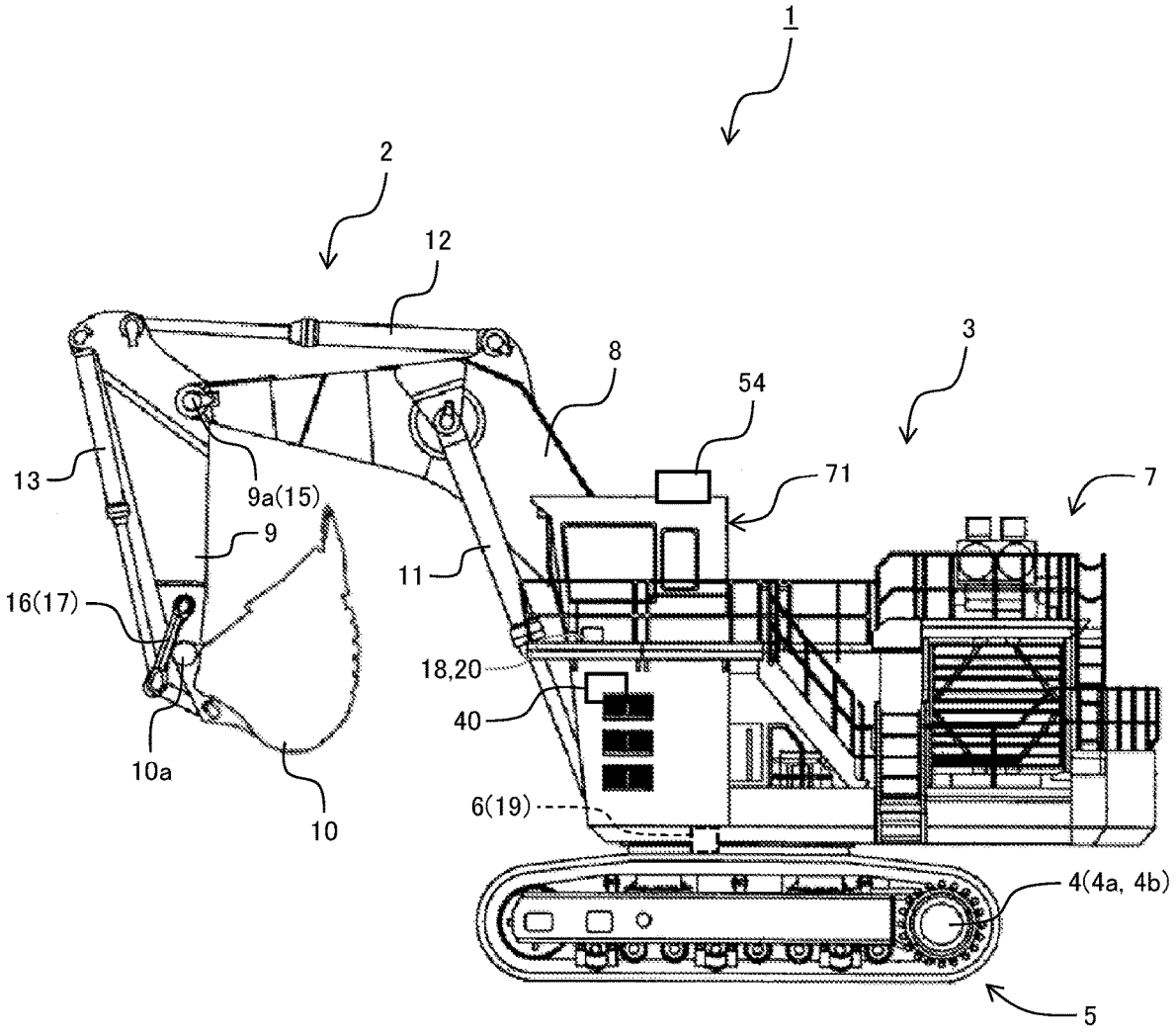
FIG. 1 is a side view for schematically depicting an appearance of a hydraulic excavator depicted as an example of a work machine.

FIG. 1 is a side view for schematically depicting an appearance of a hydraulic excavator depicted as an example of a work machine according to the present embodiment.

In FIG. 1, the hydraulic excavator 1 that is an example of the work machine performs excavation work for excavating a surface to be excavated such as the ground, and loading work for loading an object such as excavated earth and sand onto a loaded machine 200 such as a transportation machine including a dump truck (see FIG. 8 to be referred to later). The hydraulic excavator 1 performs the above transportation operation and releasing operation in this loading work. The hydraulic excavator 1 includes an articulated front work device 2 (work device) that holds an object and rotates in the vertical or front-rear direction, and a machine body 3 on which the front work device 2 is mounted.

The machine body 3 includes a lower track structure 5 that travels by a travel right hydraulic motor 4*a* and a travel left hydraulic motor 4*b* provided at a right part and a left part of the lower track structure 5, respectively, and an upper swing structure 7 that is attached to an upper part of the lower track structure 5 through a swing device and swings with respect to the lower track structure 5 by a swing hydraulic motor 6 of the swing device. It should be noted that, in the present embodiment, the travel right hydraulic motor 4*a* and the travel left hydraulic motor 4*b* may be collectively and simply referred to as travel hydraulic motors 4 (or travel hydraulic motors 4*a* and 4*b*).

The front work device 2 is an articulated work device configured using a plurality of front members attached to a front part of the upper swing structure 7. The upper swing structure 7 swings with the front work device 2 mounted thereon. The front work device 2 includes a boom 8 coupled to the front part of the upper swing structure 7 in a vertically rotatable manner, an arm 9 coupled to a tip part of the boom 8 in a vertically rotatable manner, and a bucket 10 coupled to a tip part of the arm 9 in a vertically rotatable manner.

The boom 8 is coupled to the upper swing structure 7 by a boom pin 8*a* and is rotated by extension and contraction of a boom cylinder 11. The arm 9 is coupled to the tip part of the boom 8 by an arm pin 9*a* and is rotated by extension and contraction of an arm cylinder 12. The bucket 10 is coupled to the tip part of the arm 9 by a bucket pin 10*a* and a bucket link 16 and is rotated by extension and contraction of a bucket cylinder 13.

A boom angle sensor 14 for sensing the rotation angle of the boom 8 with respect to the machine body 3 (that is, the upper swing structure 7) is attached to the boom pin 8*a*. An arm angle sensor 15 for sensing the rotation angle of the arm 9 with respect to the boom 8 is attached to the arm pin 9*a*. A bucket angle sensor 17 for sensing the rotation angle of the bucket 10 with respect to the arm 9 is attached to the bucket link 16.

It should be noted that each rotation angle of the boom 8, the arm 9, and the bucket 10 may be acquired through sensing of each angle of the boom 8, the arm 9, and the bucket 10 with respect to a reference surface such as a horizontal surface by use of an inertial measurement unit (IMU) and conversion of the sensed angle into a rotation angle. In addition, each rotation angle of the boom 8, the arm 9, and the bucket 10 may be acquired through sensing of each stroke of the boom cylinder 11, the arm cylinder 12, and the bucket cylinder 13 by use of a stroke sensor and conversion of the sensed stroke into a rotation angle.

An inclination angle sensor 18 for sensing the inclination angle of the machine body 3 with respect to a reference surface such as a horizontal surface is attached to the upper swing structure 7. A swing angle sensor 19 for sensing the swing angle of the upper swing structure 7 with respect to the lower track structure 5 is attached to the swing device provided between the lower track structure 5 and the upper swing structure 7. An angular velocity sensor 20 for sensing the swing angular velocity of the upper swing structure 7 is attached to the upper swing structure 7.

Here, the boom angle sensor 14, the arm angle sensor 15, the bucket angle sensor 17, the inclination angle sensor 18, and the swing angle sensor 19 configure a posture sensor 53 for sensing each rotation angle of the front work device 2, the swing angle of the upper swing structure 7, and the like.

An operation device for operating the plurality of hydraulic actuators 4*a*, 4*b*, 6, 11, 12, and 13 is installed in an operation room 71 provided on the upper swing structure 7. Specifically, the operation device includes a travel right lever 23*a* for operating the travel right hydraulic motor 4*a*, a travel left lever 23*b* for operating the travel left hydraulic motor 4*b*, an operation right lever 22*a* for operating the boom cylinder 11 and the bucket cylinder 13, and an operation left lever 22*b* for operating the arm cylinder 12 and the swing hydraulic motor 6. It should be noted that, in the present embodiment, the travel right lever 23*a*, the travel left lever 23*b*, the operation right lever 22*a*, and the operation left lever 22*b* are collectively referred to as operation levers 22 and 23. The operation levers 22 and 23 are of, for example, an electric lever system. In addition, the operation lever 22 includes a switch 24 for commanding execution of an automatic transportation operation.

In addition, an object sensor 54 for sensing the type and position of an object existing around the hydraulic excavator 1 that is a work machine is attached to the upper swing structure 7, for example, an upper part of the operation room 71. The object sensor 54 may be, for example, a LiDAR (Light Detection And Ranging) or a stereo camera. The object sensor 54 senses the loaded machine 200 onto which the hydraulic excavator 1 is to perform loading work, and senses the relative position of the loaded machine 200 with respect to the object sensor 54. A plurality of object sensors 54 may be attached to the hydraulic excavator 1. In addition, position information of the loaded machine 200 acquired by a server of a management office or the like at a work site may be acquired through a communication device.

Figure 2:
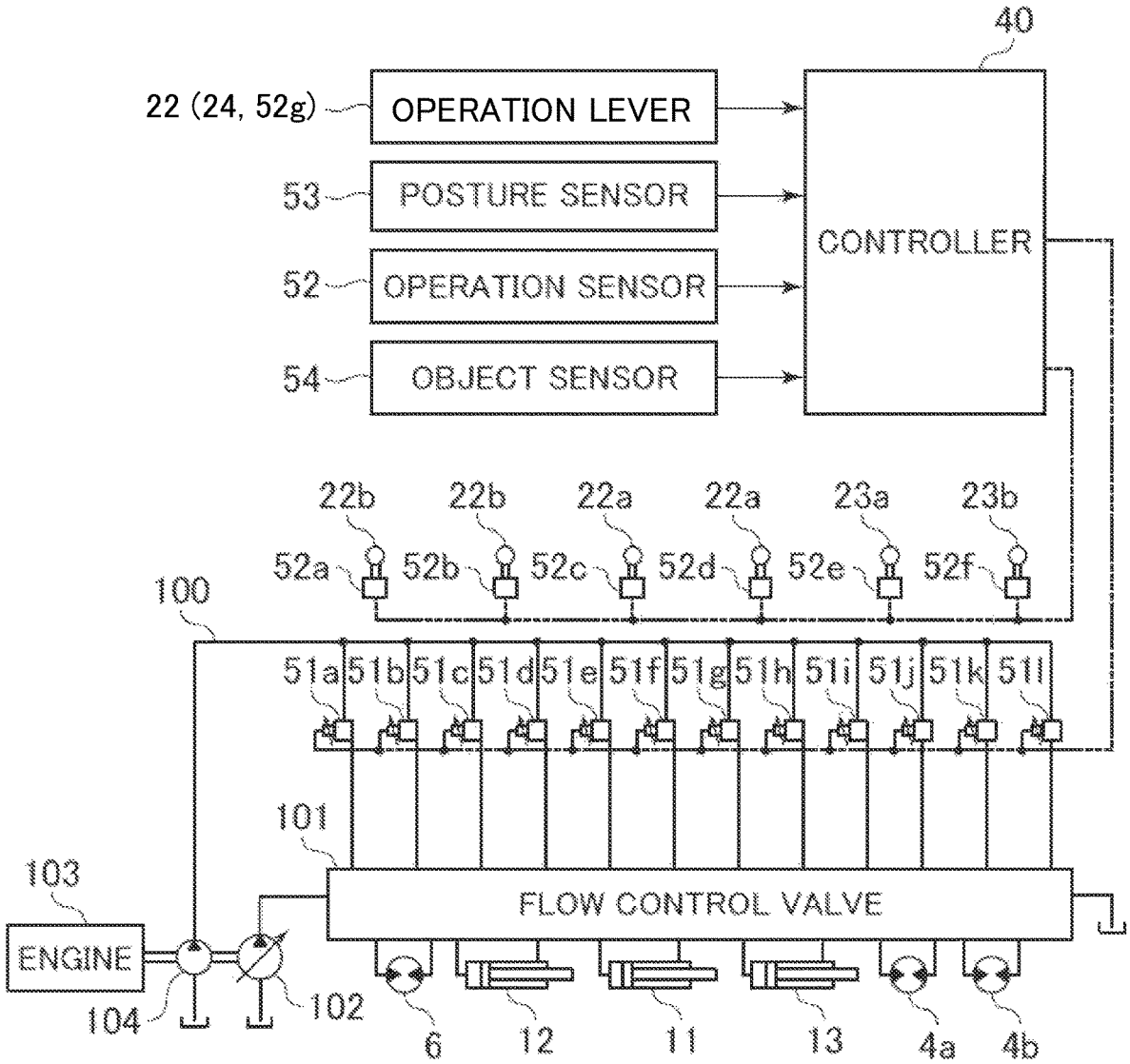
FIG. 2 is a functional block diagram for depicting a hydraulic system and a control system of the hydraulic excavator while extracting related configurations together.

FIG. 2 is a functional block diagram for depicting a hydraulic system and a control system of the hydraulic excavator while extracting related configurations together.

As depicted in FIG. 2, an engine 103 as a prime mover mounted on the upper swing structure 7 drives a hydraulic pump 102 and a pilot pump 104. A controller 40 controls the rotation operation of the front work device 2, the travel operation of the lower track structure 5, and the swing operation of the upper swing structure 7 according to operation information (operation amount and operation direction) of the operation levers 22 and 23 operated by the operator. Specifically, the controller 40 senses the operation information (operation amount and operation direction) of the operation levers 22 and 23 operated by the operator, by using sensors 52*a* to 52*f* of a rotary encoder, a potentiometer, or the like, and outputs a control command according to the sensed operation information to solenoid proportional valves 51*a* to 51*l*. The solenoid proportional valves 51*a* to 51*l* are provided on a pilot line 100, are activated when the control command from the controller 40 is input, and output a pilot pressure to a flow control valve 101 to activate the flow control valve 101. It should be noted that, in the present embodiment, the operation information of the operation levers 22 and 23 operated by the operator is also referred to as an "operation instruction of the operator." In the present embodiment, the sensors 52*a* to 52*f* for sensing the operation information and a sensor 52*g* for sensing the switch 24 for commanding an automatic transportation operation are collectively referred to as an operation sensor 52.

The flow control valve 101 controls a hydraulic fluid supplied from the hydraulic pump 102 to each of the swing hydraulic motor 6, the arm cylinder 12, the boom cylinder 11, the bucket cylinder 13, the travel right hydraulic motor 4*a*, and the travel left hydraulic motor 4*b*, according to the pilot pressure from the solenoid proportional valves 51*a* to 51*l*. It should be noted that the solenoid proportional valves 51*a* and 51*b* output the pilot pressure for controlling the hydraulic fluid supplied to the swing hydraulic motor 6 to the flow control valve 101. The solenoid proportional valves 51*c* and 51*d* output the pilot pressure for controlling the hydraulic fluid supplied to the arm cylinder 12 to the flow control valve 101. The solenoid proportional valves 51*e* and 51*f* output the pilot pressure for controlling the hydraulic fluid supplied to the boom cylinder 11 to the flow control valve 101. The solenoid proportional valves 51*g* and 51*h* output the pilot pressure for controlling the hydraulic fluid supplied to the bucket cylinder 13 to the flow control valve 101. The solenoid proportional valves 51*i* and 51*j* output the pilot pressure for controlling the hydraulic fluid supplied to the travel right hydraulic motor 4*a* to the flow control valve 101. The solenoid proportional valves 51*k* and 51*l* output the pilot pressure for controlling the hydraulic fluid supplied to the travel left hydraulic motor 4*b* to the flow control valve 101.

The boom cylinder 11, the arm cylinder 12, and the bucket cylinder 13 are extended and contracted by the supplied hydraulic fluid to rotate the boom 8, the arm 9, and the bucket 10, respectively. Accordingly, the position and posture of the bucket 10 are changed. The swing hydraulic motor 6 is rotated by the supplied hydraulic fluid to swing the upper swing structure 7. The travel right hydraulic motor 4*a* and the travel left hydraulic motor 4*b* are rotated by the supplied hydraulic fluid to cause the lower track structure 5 to travel. It should be noted that, in the present embodiment, the travel hydraulic motors 4*a* and 4*b*, the swing hydraulic motor 6, the boom cylinder 11, the arm cylinder 12, and the bucket cylinder 13 are collectively referred to as the hydraulic actuators 4*a*, 4*b*, 6, 11, 12, and 13. In addition, even in a case where no operation of the operation levers 22 and 23 is performed by the operator, the hydraulic actuators 4*a*, 4*b*, 6, 11, 12, and 13 can be driven by activation of the solenoid proportional valves 51*a* to 51*l* by a command from the controller 40 and activation of the flow control valve 101.

Figure 3:
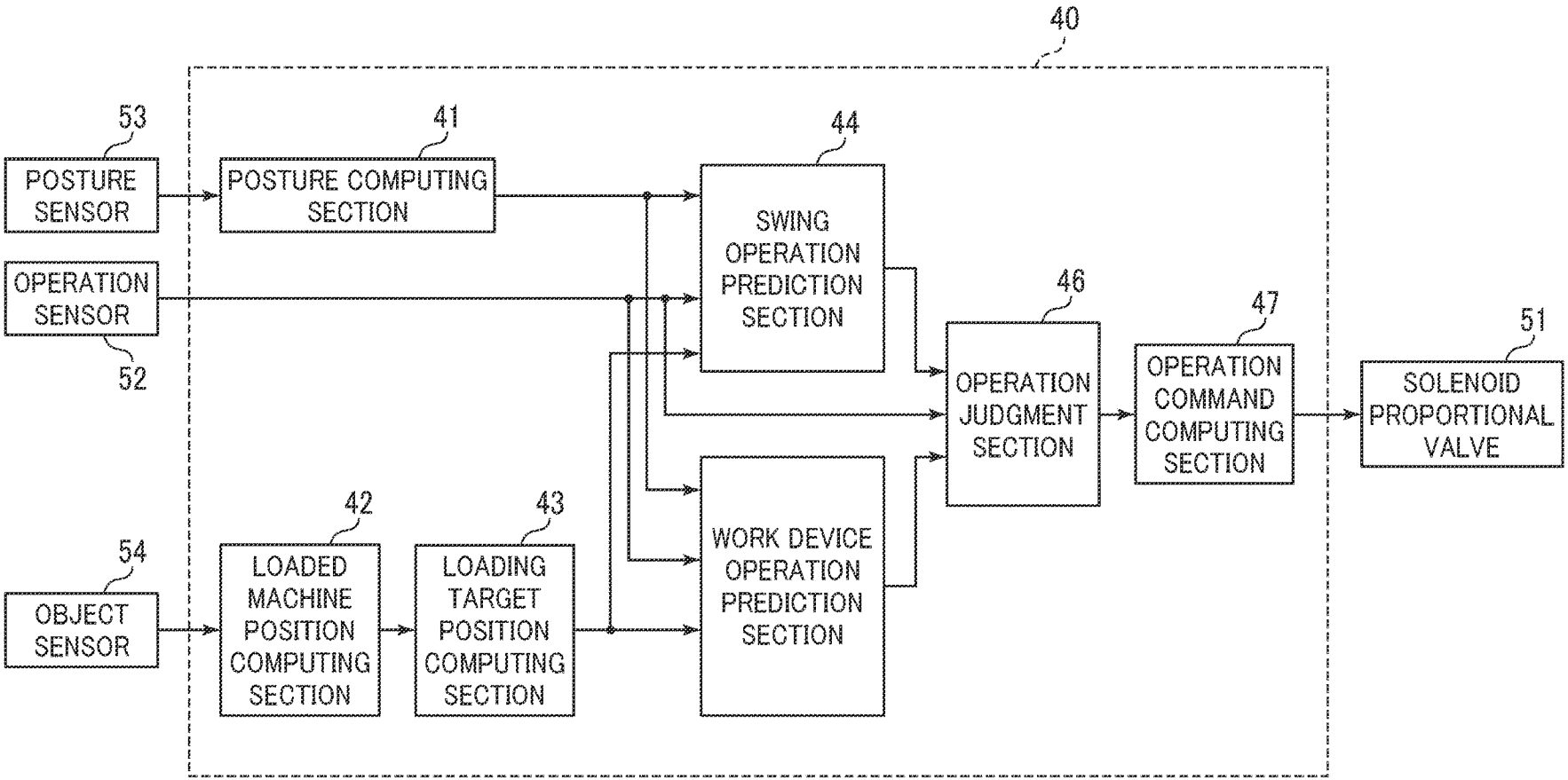
FIG. 3 is a functional block diagram for depicting a processing function of a controller while extracting related configurations together.
Figure 4:
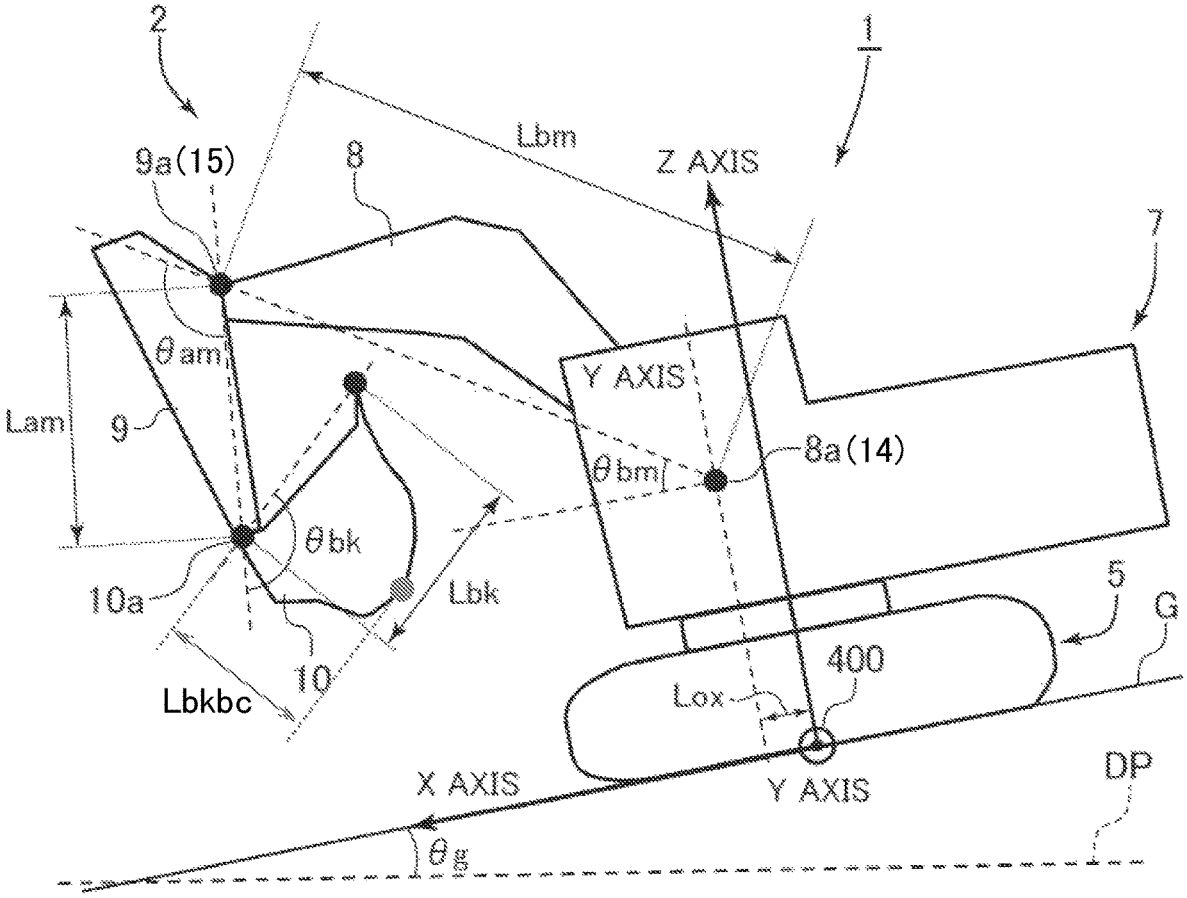
FIG. 4 is a side view for depicting a reference coordinate system together with the hydraulic excavator.
Figure 5:
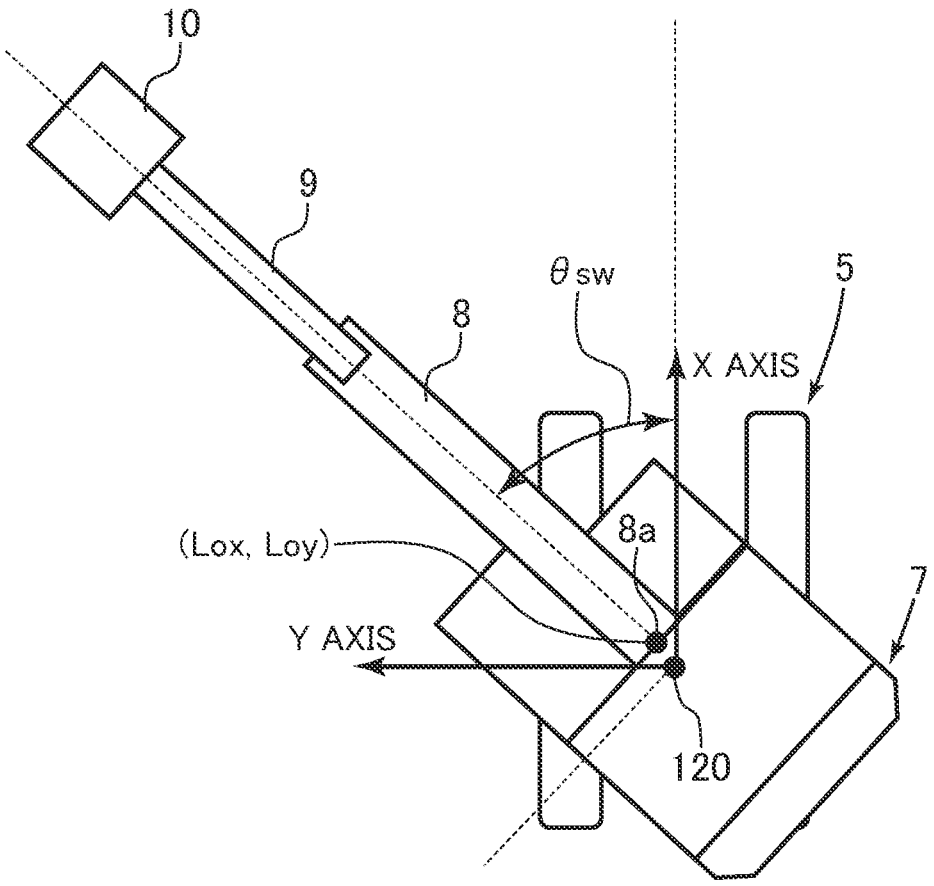
FIG. 5 is a top view for depicting the reference coordinate system together with the hydraulic excavator.

FIG. 3 is a functional block diagram for depicting a processing function of the controller while extracting related configurations together. In addition, FIG. 4 is a side view for depicting a reference coordinate system together with the hydraulic excavator, and FIG. 5 is a top view for depicting the same. In addition, FIG. 8 and FIG. 9 are diagrams each depicting an example of an operation for moving the bucket to a position above the loaded machine by a combination of the swing operation and the operation of the front work machine, and FIG. 8 is a side view and FIG. 9 is a top view.

Although illustration is omitted, the controller 40 is a computer in which a CPU (Central Processing Unit), a RAM (Random Access Memory), a ROM (Read Only Memory), an external I/F (Interface), and the like are connected to each other by a bus. The operation sensor 52, the posture sensor 53, the object sensor 54, and a storage device (for example, a hard disk drive, a large-capacity flash memory, or the like), which is not illustrated, are connected to the external I/F of the controller 40.

In FIG. 3, the controller 40 includes a posture computing section 41, a loaded machine position computing section 42, a loading target position computing section 43, a swing operation prediction section 44, a work device operation prediction section 45, an operation judgment section 46, and an operation command computing section 47.

A reference coordinate system for specifying the positions and postures of the constitutional elements of the hydraulic excavator 1 is preset in the controller 40. As depicted in FIG. 4 and FIG. 5, the reference coordinate system of the present embodiment is defined as a right-hand coordinate system in which a point where the lower track structure 5 makes contact with the ground G serves as the origin in an axis of a swing center 120. The reference coordinate system is defined with the forward direction of the lower track structure 5 as the positive direction of the X axis. The reference coordinate system of the present embodiment is defined with the direction in which the swing center 120 extends upward as the positive direction of the Z axis. The reference coordinate system of the present embodiment is defined to be orthogonal to each of the X axis and the Z axis, and the left side is the positive direction of the Y axis. In the reference coordinate system of the present embodiment, the XY plane is fixed to the ground G.

In addition, in the reference coordinate system of the present embodiment, the swing angle of the upper swing structure 7 is defined such that a state where the front work device 2 is parallel to the X axis is set as 0 degrees. In a state where the swing angle of the upper swing structure 7 is 0 degrees, the operation plane of the front work device 2 is parallel to the XZ plane, the lifting operation direction of the boom 8 is the positive direction of the Z axis, and the dumping directions of the arm 9 and the bucket 10 are the positive direction of the X axis.

The posture computing section 41 computes the postures and the like of the constitutional elements of the hydraulic excavator 1 in the reference coordinate system from sensed signals of the posture sensor 53. Specifically, the posture computing section 41 computes a rotation angle θbm of the boom 8 with respect to the X axis from the sensed signal of the rotation angle of the boom 8 output from the boom angle sensor 14. The posture computing section 41 computes a rotation angle θam of the arm 9 with respect to the boom 8 from the sensed signal of the rotation angle of the arm 9 output from the arm angle sensor 15. The posture computing section 41 computes a rotation angle θbk of the bucket 10 with respect to the arm 9 from the sensed signal of the rotation angle of the bucket 10 output from the bucket angle sensor 17. The posture computing section 41 computes a swing angle θsw of the upper swing structure 7 with respect to the X axis (lower track structure 5) from the sensed signal of the swing angle of the upper swing structure 7 output from the swing angle sensor 19.

Further, the posture computing section 41 computes each plane position and height of the boom 8, the arm 9, and the bucket 10 on the basis of the computed rotation angles θbm, θam, and θbk of the front work device 2, the computed swing angle θsw of the upper swing structure 7, a dimension Lbm of the boom 8, a dimension Lam of the arm 9, and a dimension Lbk of the bucket 10. It should be noted that the dimension Lbm of the boom 8 is the length from the boom pin 8*a* to the arm pin 9*a*. The dimension Lam of the arm 9 is the length from the arm pin 9*a* to the bucket pin 10*a*. The dimension Lbk of the bucket 10 is the length from the bucket pin 10*a* to a tip part of the bucket 10 (for example, a tip part of the tooth). In addition, when the swing angle is zero, the boom pin 8*a* is offset from the swing center by Lox in the X axis direction and by Loy in the Y axis direction.

Further, the posture computing section 41 computes an inclination angle θg of the machine body 3 (lower track structure 5) with respect to a reference surface DP from the sensed signal of the inclination angle of the machine body 3 output from the inclination angle sensor 18. The reference surface DP is, for example, a horizontal surface orthogonal to the gravity direction. The inclination angle θg includes a pitch angle that is a rotation angle about the Y axis and a roll angle that is a rotation angle about the X axis. The posture computing section 41 computes a ground angle γ that is an angle of the bucket 10 with respect to the ground G from the respective rotation angles θbm, θam, and θbk of the front work device 2. The ground angle γ of the bucket 10 is an angle formed by a straight line passing through the tip part of the bucket 10 and the bucket pin 10*a* with respect to the ground G.

The loaded machine position computing section 42 computes the position of the loaded machine 200 in the reference coordinate system from the position of the loaded machine 200 sensed by the object sensor 54. The object sensor 54 is attached to the upper swing structure 7. Accordingly, the loaded machine position computing section 42 can compute the plane position and height of the loaded machine 200 in the reference coordinate system on the basis of the swing angle θsw of the upper swing structure 7 and the attached position of the object sensor 54 with respect to the reference coordinate system.

The loading target position computing section 43 specifies the plane position and height of a soil dumping position P6 (that is, a loading position where earth and sand is loaded onto the loaded machine 200) for dumping soil onto the loaded machine 200, on the basis of the computed result of the loaded machine position computing section 42. For example, the plane position of P6 may be the center when the loaded machine 200 is viewed in plan. The height of P6 may be obtained by adding a margin Hm to the height Hv (see FIG. 8) of the loaded machine 200. For example, the margin Hm may be obtained by adding the dimension Lbk of the bucket 10. Alternatively, the margin Hm may be obtained by adding a dimension Lbkbc which is the length from the opening to the bottom of the bucket.

The loading target position computing section 43 computes a control target swing angle θswtgt for the tip of the arm 9 to reach the soil dumping position P6. This can be specified from an angle formed by a straight line extending from the boom pin 8*a* to the tip of the arm 9 and the X axis of the machine body reference coordinate in plan view.

The loading target position computing section 43 computes a target angle θbmtgt of the boom 8 and a target angle θamtgt of the arm 9 for the tip of the arm 9 to reach the soil dumping position P6. The target angle θbmtgt of the boom 8 and the target angle θamtgt of the arm 9 can be computed from the distance in plan view from the boom pin 8*a* to the soil dumping position P6 and the height from the boom pin 8*a* to the soil dumping position P6.

The loading target position computing section 43 calculates a passing position P5. For example, the height of the passing position P5 is equal to that of the soil dumping position P6. The planar position of the passing position P5 corresponds to the position of the tip of the arm 9 reached when the upper swing structure 7 has swung in the direction of the hydraulic excavator 1 at the start of automatic transportation control by a predetermined margin from the control target swing angle for reaching the soil dumping position P6. That is, the passing position P5 is a position where the tip of the arm 9 passes when, with the boom 8 and the arm 9 at the target angles, the upper swing structure 7 has swung in the control start direction by a predetermined margin from the control target swing angle. For example, the predetermined margin may be defined such that a vessel and the bucket 10 do not come into contact with each other in plan view. The swing angle obtained when the tip of the arm 9 is positioned at the passing position P5 is assumed to be a passing position swing angle.

In other words, the passing position P5 is, for example, a virtual point that defines a height position and a swing position through which the arm 9 should pass to reach the soil dumping position P6 from an excavation position P1 while avoiding contact with the loaded machine 200. In addition, the passing position P5 can be calculated on the basis of, for example, the excavation position P1 and the soil dumping position P6 (for example, the relative positional relation between the excavation position P1 and the soil dumping position P6) and the position of the loaded machine 200. In addition, the passing position P5 can be calculated in consideration of, for example, the position of the front work device 2 at the excavation position P1 (for example, the position of the tip of the arm 9 in the present embodiment), the posture of the front work device 2 at the excavation position P1 and the soil dumping position P6, the external shape of the loaded machine 200, and the shape of the excavation object that has already been loaded on the loaded machine 200.

The swing operation prediction section 44 predicts a swing operation performed when the hydraulic excavator 1 automatically performs a swing operation, on the basis of outputs from the operation sensor 52, the posture computing section 41, and the loading target position computing section 43. The swing operation prediction section 44 predicts a time history of the operation from the swing angle (control start swing angle) at the time when the operator instructs transportation to the swing angle (passing position swing angle) to be reached when stopping at the passing position P5. The time history for predicting a time T_swds at which the swing starts to decelerate includes the prediction of an operation in which the swing operation starts and the swing accelerates and the prediction of a decelerating operation for stopping at the passing position swing angle.

For example, the accelerating swing operation can be predicted by using the following (Equation 1) in which the relation of a predicted swing angular velocity ωswpre with respect to a flow rate q is represented by a secondary delay system.

[Math. 1]

$$\omega_{swpre} = \frac{K_s \omega_{nsw}^2}{s^2 + 2\zeta_{nsw}\omega_{sw}s + \omega_{nsw}^2} q \qquad \text{(Equation 1)}$$

Here, in the above (Equation 1), s represents a Laplace operator, Ks represents a gain, ωnsw represents a natural angular frequency, and ζnsw represents a damping ratio.

A predicted swing angle θswpre is obtained by integrating the angular velocity calculated by Equation 1. It should be noted that, for the prediction, a more detailed hydraulic model may be used, or data of the actually measured swing angular velocity may be used, and the prediction method is not limited.

The deceleration operation in which the swing operation decelerates and stops at a control end swing angle, that is, a swing flow angle θswd from the start of the deceleration to the stop of the swing operation, can be obtained by the following (Equation 2).

[Math. 2]

$$\theta_{swd} = \frac{\omega_{sw}^2}{2D_{lim}} \qquad \text{(Equation 2)}$$

Here, in the above (Equation 2), ωsw is a swing angular velocity, and Dlim is a deceleration that the hydraulic excavator 1 can generate in the deceleration of the swing.

From the above (Equation 2), the swing operation starts to decelerate when the sum of the swing flow angle θswd and the swing angle θsw becomes equal to the passing position swing angle, and the time history until the swing operation starts to decelerate and the time when the deceleration starts after the swing operation starts can thus be predicted. It should be noted that the predicted time period from the start of the swing operation to the start of the deceleration of the swing operation is assumed to be T_swds.

The work device operation prediction section 45 predicts the operation of the front work device 2 performed when the hydraulic excavator 1 automatically performs the transportation operation, on the basis of outputs from the operation sensor 52, the posture computing section 41, and the loading target position computing section 43. The operation of the front work device 2 is predicted from the time when the swing operation starts. The time history to be predicted includes prediction of an operation in which the front work device 2 already in operation decelerates by the swing operation, and prediction of the deceleration operation to stop the boom 8 and the arm 9 at the target angles in order to reach the soil dumping position P6. This is because, in the control flow to be described later, since the front work device 2 starts the operation before the swing operation, the supply amount of the hydraulic operating fluid for driving the front work device 2 is reduced by the swing operation, and the deceleration of the operation of the front work device 2 is considered.

For example, the deceleration of the front work device 2 by the swing operation can be predicted by using the following (Equation 3) in which the relation of a cylinder velocity Vcyl with respect to the flow rate q is represented by the secondary delay system.

[Math. 3]

$$V_{cyl} = \frac{K_f \omega_{nf}^2}{s^2 + 2\zeta_{nf}\omega_f s + \omega_{nf}^2} q \quad \text{(Equation 3)}$$

Here, in the above (Equation 3), s represents a Laplace operator, Kf represents a gain, ωnf represents a natural angular frequency, and ζnf represents a damping ratio.

It should be noted that a more detailed hydraulic model may be used for the prediction, or the relation of the cylinder velocity Vcyl between a case where the front work device 2 is operated alone and a case where the front work device 2 is operated in combination with the swing operation can be held in advance and used for the prediction of the deceleration by the swing operation.

The deceleration operation for decelerating the operations of the boom 8 and the arm 9 and stopping at the target angles of the boom 8 and the arm 9 can also be predicted as with the prediction of the deceleration of the swing operation. That is, the operation to the stop can be predicted by starting the deceleration when the sum of a change in the angle until they stop in a case where they are decelerated at a specific deceleration and an angle at a certain point in the prediction becomes equal to the target angle. In other words, the time history and time of the operation of the front work device 2 until the tip of the arm 9 reaches the soil dumping position P6 and the passing position P5 can be predicted. It should be noted that the predicted time period from the start of the swing operation to the stop of the operation of the front work device 2 is assumed to be T_fr.

Between the angle of the boom 8 and the angle of the arm 9, which need to be changed from the posture at the end of excavation to reach the soil dumping position P6, the angle of the boom 8 is larger in many cases. Therefore, the work device operation prediction section 45 may be configured to only predict the operation of the boom 8. In addition, regarding the soil dumping position P6 and the passing position P5, if it is judged that it is possible to reach the position above the loaded machine 200 only by the operation of the boom 8 and the swing operation while keeping the angle of the arm 9 at the end of excavation, the soil dumping position P6 need not be limited to the center of the loaded machine 200. In this case, the work device operation prediction section 45 only needs to predict the operation of the boom 8.

The operation judgment section 46 judges whether or not to perform the swing operation, on the basis of outputs from the operation sensor 52, the swing operation prediction section 44, and the work device operation prediction section 45. That is, the operation judgment section 46 judges whether or not to perform the swing operation, on the basis of the predicted time period T_swds, which is predicted by the swing operation prediction section 44, until the swing starts to decelerate from the start of the swing and the predicted time period T_fr, which is predicted by the work device operation prediction section 45, until the work device stops from the start of the swing.

The operation judgment section 46 judges to start the swing operation in a case where T_swds is equal to T_fr, or T_swds is larger than T_fr, that is, in a case where it is predicted to stop at the passing position swing angle if the swing operation starts to decelerate at the same time when or after the tip of the arm 9 reaches the height and reach to reach P6.

The operation command computing section 47 outputs a command to the solenoid proportional valves 51 on the basis of the judgment result of the operation judgment section 46. Specifically, when the operator instructs the transportation of the earth and sand excavated by the hydraulic excavator 1 to the loaded machine 200, the operation command computing section 47 commands the solenoid proportional valves 51 to operate the hydraulic actuators of the front work device 2. In addition, when the operation judgment section 46 judges to start the swing operation, the operation command computing section 47 commands the solenoid proportional valves 51 to perform the swing operation. The operator of the hydraulic excavator 1 instructs the transportation of the earth and sand excavated by the hydraulic excavator 1 and held in the bucket 10 to the loaded machine 200, by operating the switch 24 on the operation lever 22.

Figure 6:
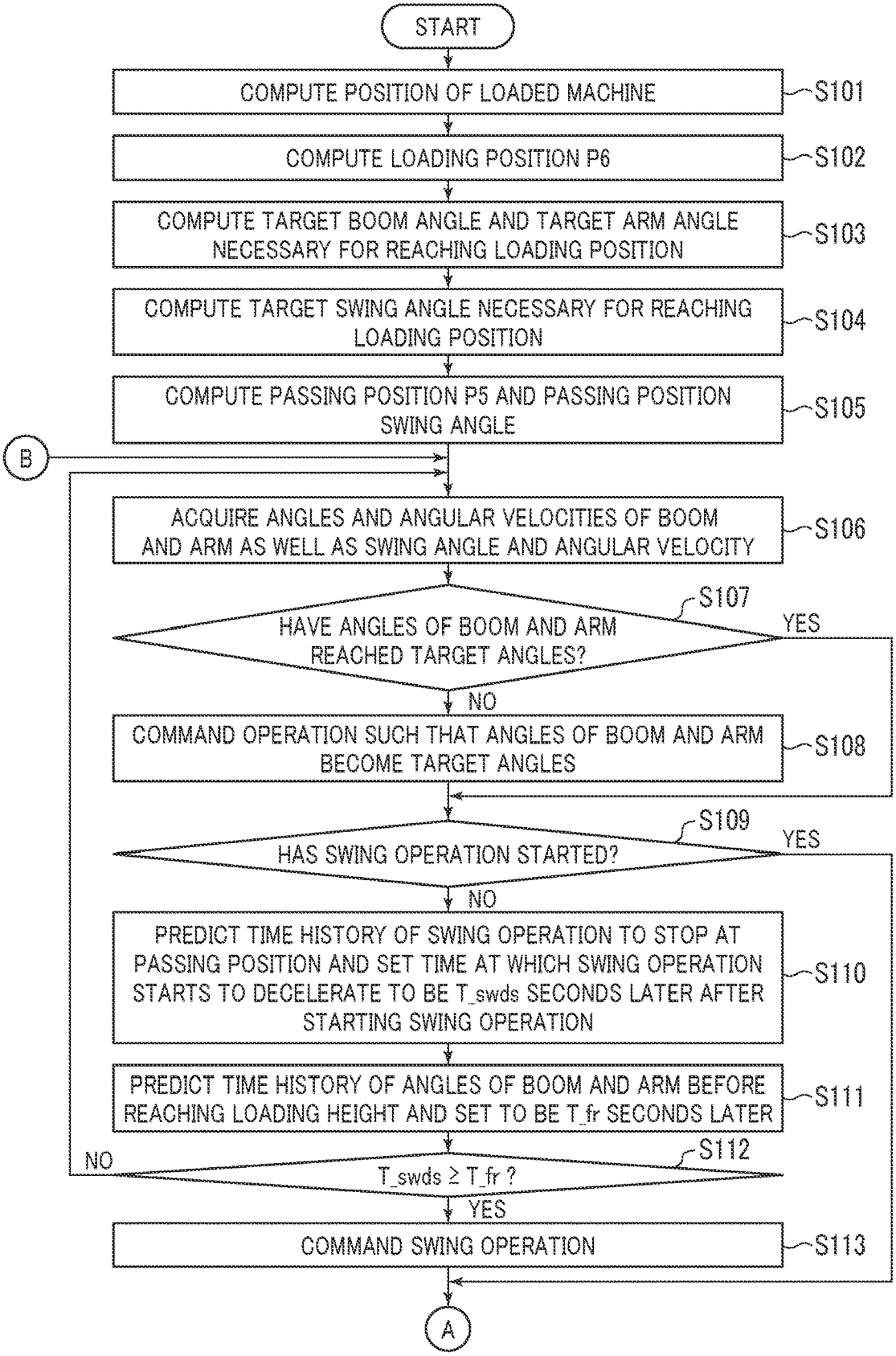
FIG. 6 is a flow chart for depicting processing contents in a transportation operation.
Figure 7:
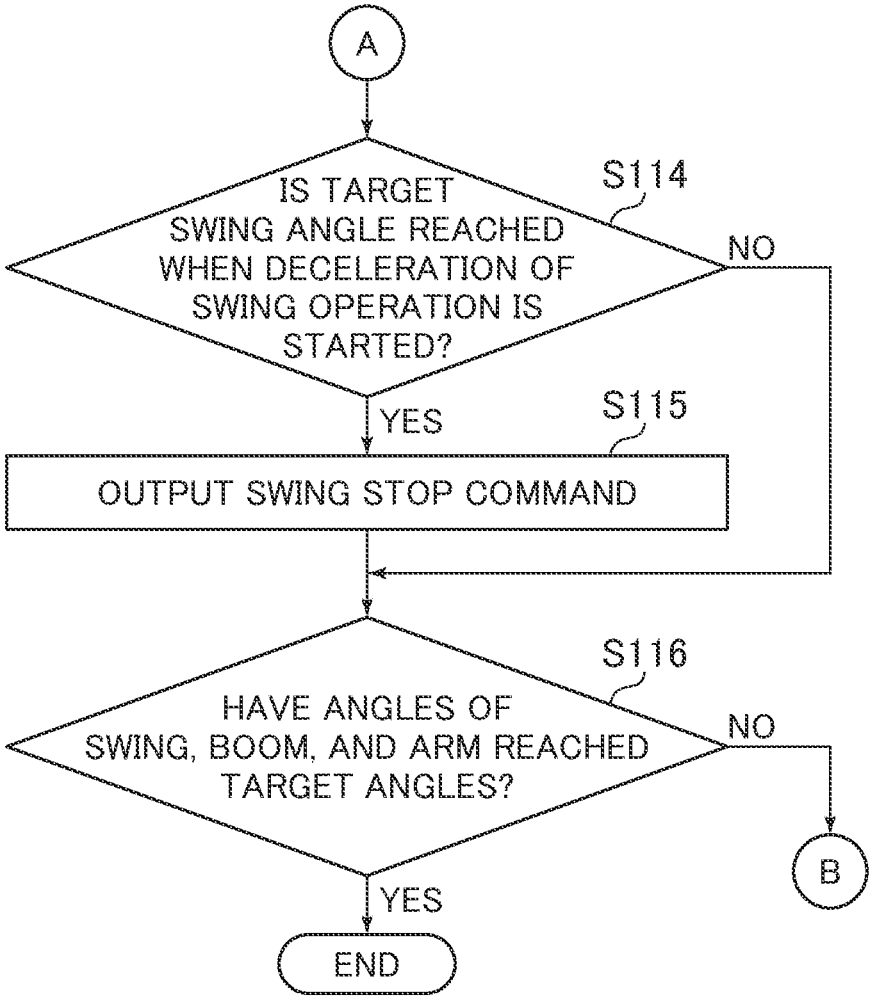
FIG. 7 is a flow chart for depicting processing contents in the transportation operation.

FIG. 6 and FIG. 7 are flow charts for depicting processing contents in the transportation operation.

In FIG. 6 and FIG. 7, when the operation sensor 52 senses an instruction of the automatic transportation operation by the operation of the switch 24 by the operator, the loaded machine position computing section 42 of the controller 40 first computes the position of the loaded machine 200 on the basis of information from the object sensor 54 (Step S101).

Subsequently, the loading target position computing section 43 computes the soil dumping position P6 (Step S102).

Subsequently, the loading target position computing section 43 computes the target angle θbmtgt of the boom 8 and the target angle θamtgt of the arm 9 necessary for the tip of the arm 9 to reach the soil dumping position P6 (Step S103).

Subsequently, the loading target position computing section 43 computes the target swing angle θswtgt that is the swing angle necessary for the tip of the arm 9 to reach the soil dumping position P6 (Step S104).

Subsequently, the loading target position computing section 43 computes the passing position P5 and the passing position swing angle (Step S105).

Subsequently, the posture computing section 41 computes the angles and angular velocities of the boom 8 and the arm 9 as well as the swing angle and angular velocity on the basis of the information from the posture sensor 53 (Step S106).

Subsequently, it is determined whether or not the angles of the boom 8 and the arm 9 have reached the target angles (Step S107).

When the determination result in Step S107 is NO, that is, when it is determined that the target angles have not been reached, then the operation command computing section 47 instructs the solenoid proportional valves 51 such that the angles of the boom 8 and the arm 9 reach the target angles (Step S108).

When the determination result in Step S107 is YES, or when the processing of Step S108 is finished, that is, when the target angles have been reached, then it is determined whether or not the swing operation has started (Step S109). It should be noted that whether or not the swing operation has started may be determined by using the calculation result of the swing angular velocity by the posture computing section 41 or by storing whether the swing operation command has been performed.

When the determination result in Step S109 is NO, that is, when it is determined that the swing operation has not started, then the swing operation prediction section 44 predicts the time history of the swing operation until the tip of the arm 9 reaches the passing position P5 (Step S110). The prediction of the swing operation includes at least the period from the start of the swing operation to the start of the deceleration of the swing operation. The time period from the start of the swing operation to the start of the deceleration of the swing operation is stored as T_swds.

Subsequently, the work device operation prediction section 45 predicts the time history of the operations of the boom 8 and the arm 9 until the tip of the arm 9 reaches the soil dumping position P6 and the passing position P5, in other words, the time history until the boom 8 and the arm 9 reach the target angles, by using the time at which the swing starts as an initial value (Step S111). The angles and angular velocities of the boom 8 and the arm 9 acquired in Step S106 can be used for the initial value for predicting the operation of the work device. The time period after which it is predicted to reach the target angles is stored as T_fr.

Subsequently, the operation judgment section 46 compares T_swds with T_fr to judge whether or not T_swds is equal to or larger than T_fr, that is, whether it is predicted that the swing stops at the passing position P5 if the swing operation starts to decelerate at the same time when or after the boom 8 and the arm 9 reach the target angles (Step S112).

When the determination result in Step S112 is NO, that is, when T_swds is not equal to or larger than T_fr, the processing of Steps S106 to S111 is repeated until the determination result becomes YES. It should be noted that, in Step S111, when either the boom 8 or the arm 9 reaches the target angle during the repeated processing of Steps S106 to S111, which occurs when the determination result in Step S112 is NO, only the operation of the one that has not yet reached the target angle may be predicted.

In addition, when the determination result in Step S112 is YES, that is, when T_swds is equal to or larger than T_fr, then the operation command computing section 47 commands the swing operation (Step S113).

Subsequently, when the determination result in Step S109 is YES, or when the processing in Step S113 has been finished, that is, when the swing operation has started, then it is determined whether or not the target swing angle is reached when the deceleration of the swing operation is started (Step S114).

When the determination result in Step S114 is YES, that is, when it is determined that the target swing angle is reached, then a swing stop command is output (Step S115).

In addition, when the determination result in Step S114 is NO, or when the processing in Step S115 has been finished, then it is determined whether or not the swing angle, the angle of the boom 8, and the angle of the arm 9 have reached the target angles (Step S116).

When the determination result in Step S116 is NO, that is, when it is determined that the target angles have not been reached, the flow returns to the processing of Step S106.

In addition, when the determination result in Step S116 is YES, the processing of the automatic transportation operation is finished.

An operation in the present embodiment configured as described above will be described.

Figure 8:
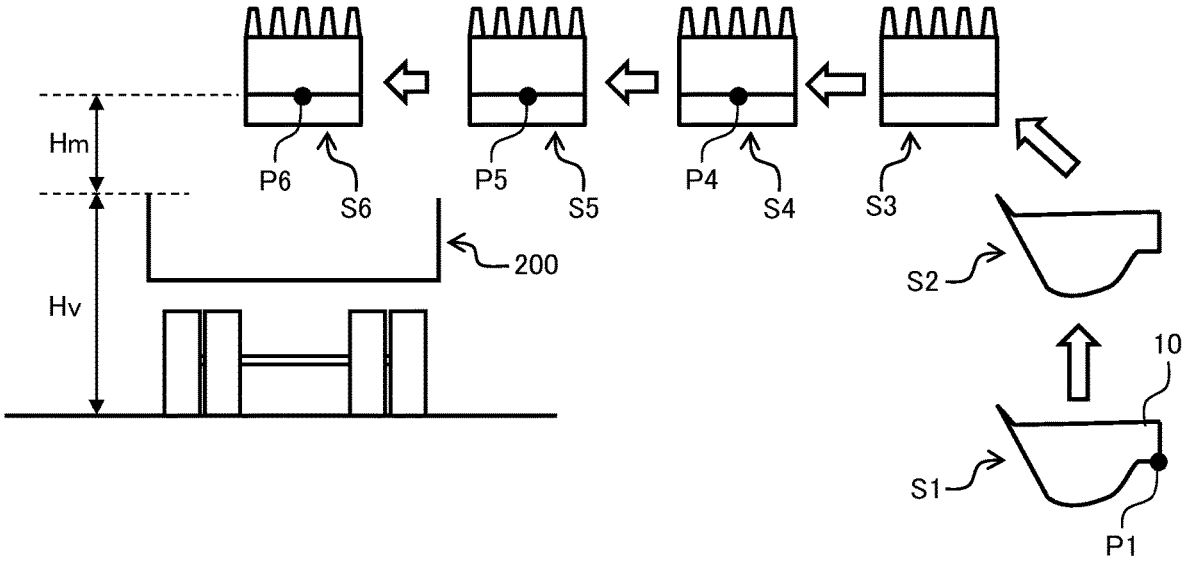
FIG. 8 is a side view for depicting an example of an operation for moving a bucket to a position above a loaded machine by a combination of a swing operation and an operation of a front work device.
Figure 9:
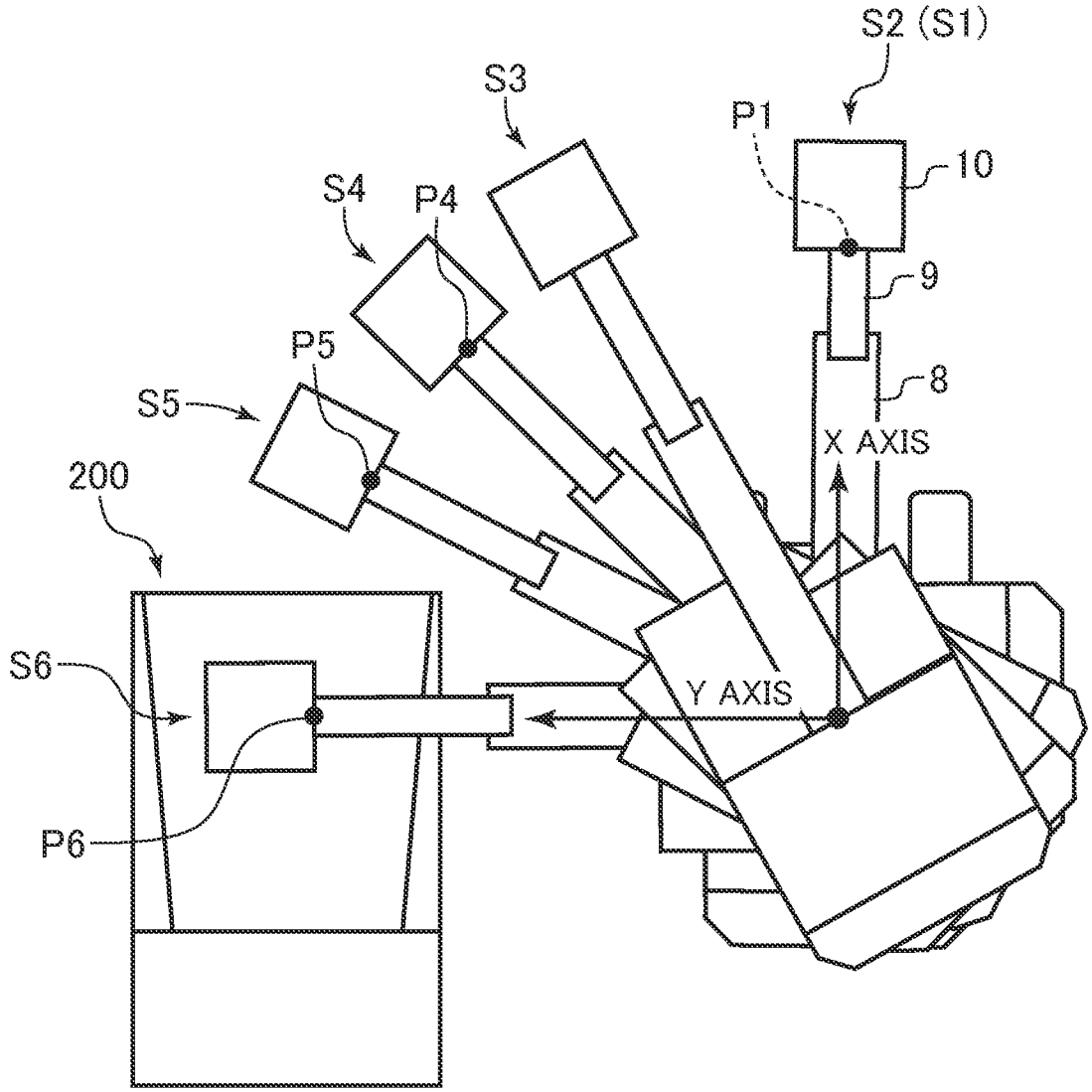
FIG. 9 is a top view for depicting the example of the operation for moving the bucket to the position above the loaded machine by the combination of the swing operation and the operation of the front work device.

As depicted in FIG. 8 and FIG. 9, the state of the bucket 10 at the end of the excavation at the excavation position P1 is assumed to be a state S1. At this point, the operator instructs the automatic transportation operation. Only the boom 8 and the arm 9 operate between the state S1 and a state S2. In the flowchart of FIG. 6, the processing state at this time corresponds to the case where it is judged in Step S112 that T_swds is not equal to or larger than T_fr and the processing of Steps S106 to S111 is repeated. Therefore, the state is moved from the state S1 to the state S2 only by the operations of the boom 8 and the arm 9.

In the state S2, when it is determined in Step S112 of the flowchart of FIG. 6 that T_swds is equal to or larger than T_fr, the swing operation starts (see Step S113 of FIG. 6), the boom 8 and the arm 9 move simultaneously with the swing operation, and the bucket 10 moves from the state S2 to a state S3.

The state S3 is a state in which both of the operations of the boom 8 and the arm 9 are completed. The processing state at this time corresponds to the case where it is determined in Step S107 of the flowchart of FIG. 6 that the angles of the boom 8 and the arm 9 have reached the target angles. In the state S3, the swing operation has not yet started to decelerate.

A state S4 is the point at which the swing operation starts to decelerate, and is the situation of passing a position P4 (swing deceleration start position). The processing state at this time corresponds to the case where it is determined in Step S114 of the flowchart of FIG. 7 that the target swing angle is reached when the swing operation starts to decelerate, and where the swing stop command is output (see Step S115 of FIG. 7).

A state S5 is a situation in which the tip of the arm 9 is passing through the passing position P5 that is the position where a margin of a predetermined swing angle is provided for the target swing angle for reaching the soil dumping position P6 while the swing operation decelerates.

When the swing operation finally stops, the state reaches a state S6, the swing operation stops, and the tip of the arm 9 stops at the soil dumping position P6.

The effects in the present embodiment configured as described above will be described.

In the prior art, for the operation of the front work device 2 such as the boom 8 and the arm 9, the swing operation requires time to stop even after receiving a stop command. Therefore, in the case of such an automatic transportation operation that the lifting operation of the front work device 2 is finished in the vicinity of the loaded machine 200, even if the stop of the operation is instructed during the automatic transportation operation, it is necessary to continuously operate the front work device 2 in order to avoid interference with the loaded machine 200. However, in such an operation, it is conceivable that the operation made by the operator significantly deviates from the actual operation, and there is a concern that the operator feels discomfort. Therefore, in the prior art, even in a case where the loading operation is stopped in the middle, it is necessary to continue the operation of the bucket to the height direction in order to prevent the interference between the loaded machine and the bucket. That is, there is a concern that the operator feels discomfort due to the deviation between the operation made by the operator and the actual operation.

On the other hand, in the present embodiment, the operations of the upper swing structure and the front work device are controlled on the basis of the prediction results of the swing operation and the operation of the front work device such that the swing operation of the upper swing structure starts after the work tool starts only the lifting operation, the lifting operation and the swing operation are performed until the work tool reaches the height position of the passing position, only the swing operation is performed after the work tool reaches the height position of the passing position, the swing operation of the upper swing structure starts to decelerate at the swing deceleration start position, and only the swing operation is performed until the work tool reaches the swing position of the passing position to pass through the passing position. Therefore, it is possible to reduce the discomfort feeling of the operator while realizing interference prevention at the time of a loading operation and a stop during the loading operation.

That is, in the present embodiment, in a case where the stop of the automatic transportation operation is instructed during the transition from the state S1 to the state S2, since the swing operation has not yet started, there is no risk of interference with the loaded machine 200 even if the operations of the boom 8 and the arm 9 are immediately stopped. In addition, in a case where the stop of the automatic transportation operation is instructed during the transition from the state S2 to the state S3, if the swing is stopped from the position, it is possible to stop at the swing angle at the passing position P5 before the loaded machine 200 or before reaching the passing position P5, and therefore, there is no risk of interference with the loaded machine 200 even if the operations of the boom 8 and the arm 9 are immediately stopped. Further, in a case where the stop of the automatic transportation operation is instructed in the state S3 or later, since the bucket 10 has already risen to a height that does not interfere with the loaded machine 200, there is no risk of interference.

In addition, according to the present embodiment, in the transportation operation performed by combining the swing operation and the operation of the front work device 2, since the operation of the front work device 2 is carried out in advance, the operator can command the automatic transportation operation without worrying about the interference with the loaded machine 200.

It should be noted that the deceleration of the swing in the case of stopping at the passing position P5 which deceleration is predicted by the swing operation prediction section 44 may be equal to the deceleration of the swing used for judging the deceleration for stopping the swing operation at the target swing angle in Step S114 of the flowchart of FIG. 7, or the deceleration in the case of stopping at the passing position P5 may have such a different value as to become a large deceleration. For example, the deceleration in the case of stopping at the passing position P5 may be the maximum deceleration that the hydraulic excavator 1 can generate, and the deceleration in the case of stopping at the target swing angle may be a deceleration smaller than the maximum deceleration. In this case, by relatively reducing the deceleration when the actual swing operation is decelerated, it is possible to reduce the discomfort feeling of the operator.

In addition, in the present embodiment, a case where the angles of the boom 8 and the arm 9 are controlled has been exemplified and described, but this is not limitative. For example, the ground angle of the bucket 10 when the automatic transportation control is instructed by the operator may be controlled to be held during the execution of the automatic transportation control, or control may be performed such that an operation instruction of the bucket 10 by the operator is received.

Second Embodiment

A second embodiment of the present invention will be described with reference to FIG. 10 and FIG. 11. In the drawings, members similar to those of the other embodiment will be denoted by the same reference characters, and the description thereof will be omitted.

Figure 10:
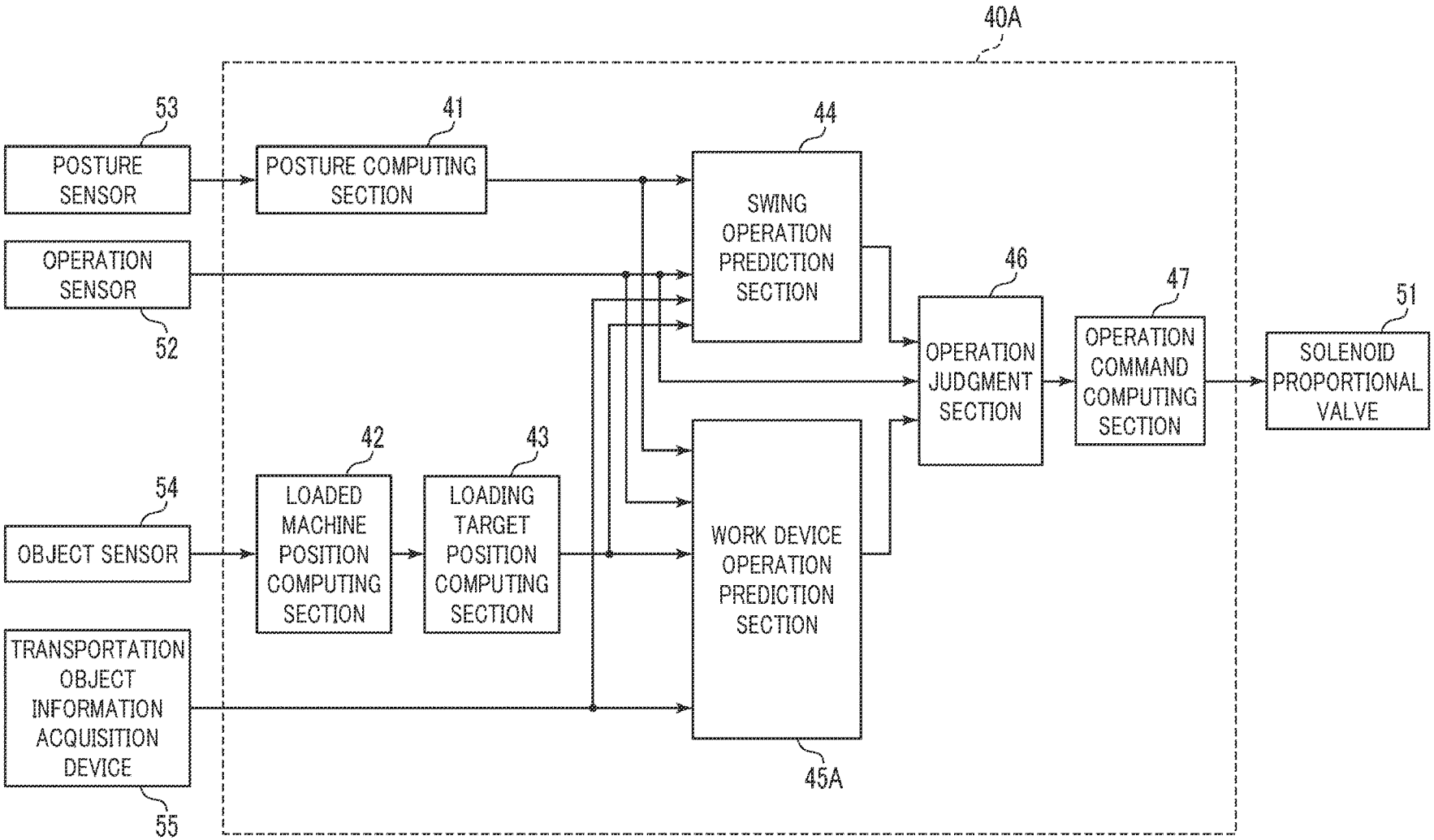
FIG. 10 is a functional block diagram for depicting a processing function of a controller according to a second embodiment while extracting related configurations together.

FIG. 10 is a functional block diagram for depicting a processing function of a controller while extracting related configurations together. In addition, FIG. 11 is a diagram for depicting an extracted part of the flowchart depicting the processing contents in the transportation operation.

In FIG. 10, the hydraulic excavator 1 includes a transportation object information acquisition device 55. The transportation object information acquisition device 55 calculates the mass of a transportation object (for example, excavated earth and sand) stored in the bucket 10. The controller 40A performs prediction in the swing operation prediction section 44 and the work device operation prediction section 45A by using information obtained by the transportation object information acquisition device 55.

Figure 11:
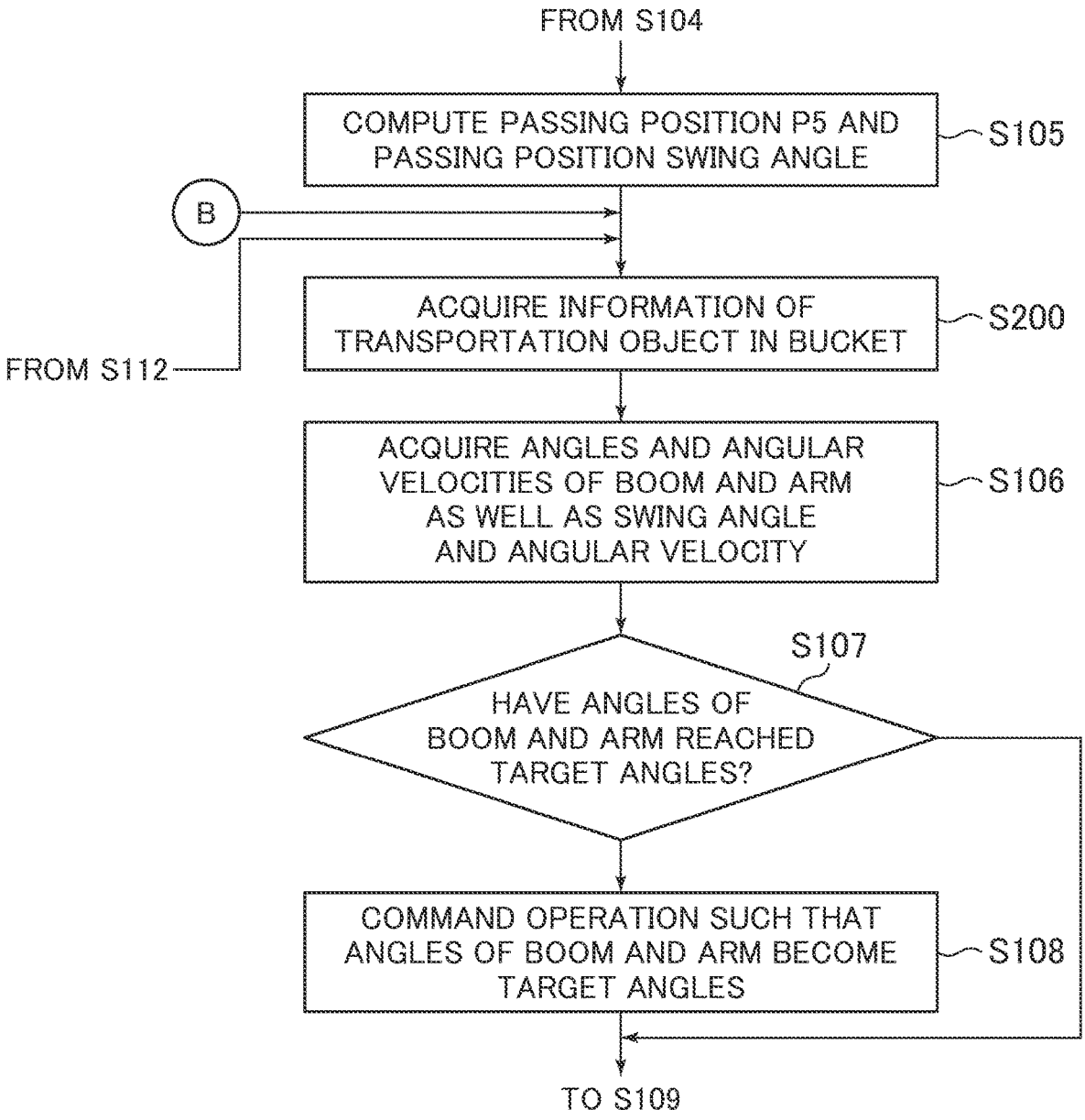
FIG. 11 is a diagram for depicting an extracted part of a flowchart depicting processing contents in a transportation operation according to the second embodiment.

The flowchart depicted in FIG. 11 differs from the flowchart depicted in FIG. 7 in that processing (Step S200) for acquiring the transportation object information in the bucket 10 is added before the processing of Step S106. By using the information of the transportation object in the bucket 10 as in Step S200, the swing operation prediction section 44 and the work device operation prediction section 45 of the controller 40 can perform operation prediction with higher accuracy.

Other configurations are similar to those of the first embodiment.

Even in the present embodiment configured as described above, the effects similar to those of the first embodiment can be obtained.

In addition, the controller 40 can perform operation prediction with higher accuracy.

SUPPLEMENTARY NOTE

It should be noted that the present invention is not limited to the above embodiments and includes various modified examples and combinations within the range without deviating from the gist thereof. In addition, the present invention is not limited to those including all of the configurations described in the above embodiments and also includes those in which some of the configurations are deleted. In addition, some or all of the above configurations, functions, and the like may be realized by, for example, designing with an integrated circuit. In addition, the above configurations, functions, and the like may be realized by software by a processor interpreting and executing a program for realizing each function.

DESCRIPTION OF REFERENCE CHARACTERS

1: Hydraulic excavator
2: Front work device
3: Machine body
4: Travel hydraulic motor
5: Lower track structure
6: Swing hydraulic motor
7: Upper swing structure
8: Boom
8*a*: Boom pin
9: Arm
9*a*: Arm pin
10: Bucket
10*a*: Bucket pin
11: Boom cylinder
12: Arm cylinder
13: Bucket cylinder
14: Boom angle sensor
15: Arm angle sensor
16: Bucket link
17: Bucket angle sensor

18: Inclination angle sensor
19: Swing angle sensor
20: Angular velocity sensor
22, 23: Operation lever
24: Switch
40: Controller
41: Posture computing section
42: Loaded machine position computing section
43: Loading target position computing section
44: Swing operation prediction section
45: Work device operation prediction section
46: Operation judgment section
47: Operation command computing section
51: Solenoid proportional valve
52: Operation sensor
53: Posture sensor
54: Object sensor
55: Transportation object information acquisition device
71: Operation room
100: Pilot line
101: Flow control valve
102: Hydraulic pump
103: Engine
104: Pilot pump
120: Swing center
200: Loaded machine (dump truck)

The invention claimed is:

1. A work machine comprising:

a lower track structure;

an upper swing structure that is swingably attached onto the lower track structure;

an articulated front work device that is attached to the upper swing structure and has a boom, an arm, and a work tool;

a posture sensor that senses postures of the upper swing structure and the front work device;

a loaded machine position sensor that senses a position of a loaded machine for loading and transporting an excavation object excavated by the front work device; and a controller configured to control at least a part of operations of the upper swing structure and the front work device related to a loading operation of loading the excavation object onto the loaded machine, according to information regarding an excavation position of the excavation object and a soil dumping position of the excavation object onto the loaded machine, wherein the controller is configured to, in the loading operation, compute a height position and a swing position that are positions in a vertical direction and a swing direction, respectively, of a passing position through which the work tool is caused to pass in order for the work tool to reach the soil dumping position from the excavation position while avoiding contact with the loaded machine, on a basis of the excavation position, the soil dumping position, and the position of the loaded machine, and compute, in a swing operation of the upper swing structure until the work tool stops at the soil dumping position after passing through the passing position from the excavation position, a swing deceleration start position at which the upper swing structure starts to decelerate, on a basis of prediction of a change in a swing angle of the upper swing structure from a state where the upper swing structure swings at a predetermined speed until it stops at the soil dumping position, and control operations of the upper swing structure and the front work device such that the swing operation of the upper swing structure starts after the work tool starts only a lifting operation, the lifting operation and the swing operation are performed until the work tool reaches the height position of the passing position, only the swing operation is performed after the work tool reaches the height position of the passing position, the swing operation of the upper swing structure starts to decelerate at the swing deceleration start position, and only the swing operation is performed until the work tool reaches the swing position of the passing position to pass through the passing position.

2. The work machine according to claim 1, wherein the controller is configured to predict a time period required for the work tool to reach the height position of the passing position after it starts the lifting operation in a case where the work tool performs the lifting operation at a fastest speed and a time period required for the upper swing structure to stop after it starts to decelerate in a case where the upper swing structure performs the swing operation at a fastest speed, and control, according to the required time periods, the work tool in such a manner as to stop at a swing position at which it does not reach the swing position of the passing position, when the lifting operation of the work tool and the swing operation of the upper swing structure start to stop by receiving a signal for interrupting automatic control of the upper swing structure and the front work device in a case where the work tool performs the lifting operation.

3. The work machine according to claim 1, wherein the controller is configured to use a deceleration larger than that used when the upper swing structure stops at the soil dumping position after starting to decelerate, as a deceleration of the upper swing structure used for predicting a time period required for the upper swing structure to stop after it starts to decelerate.

4. The work machine according to claim 1, wherein the controller is configured to predict the operations of the upper swing structure and the front work device by using information of a transportation object held by the work tool.

* * * * *